US009261063B2

(12) United States Patent
Honda et al.

(10) Patent No.: US 9,261,063 B2
(45) Date of Patent: Feb. 16, 2016

(54) VEHICLE OIL PUMP

(75) Inventors: Atsushi Honda, Seto (JP); Hiroyasu Honda, Toyota (JP)

(73) Assignee: TOYOTA JIDOSHA KABUSHIKI KAISHA, Aichi (JP)

( * ) Notice: Subject to any disclaimer, the term of this patent is extended or adjusted under 35 U.S.C. 154(b) by 216 days.

(21) Appl. No.: 14/009,406

(22) PCT Filed: Apr. 4, 2011

(86) PCT No.: PCT/JP2011/058558

§ 371 (c)(1),
(2), (4) Date: Oct. 2, 2013

(87) PCT Pub. No.: WO2012/137292

PCT Pub. Date: Oct. 11, 2012

(65) Prior Publication Data

US 2014/0020662 A1 Jan. 23, 2014

(51) Int. Cl.

| | |
|---|---|
| ***F02B 67/00*** | (2006.01) |
| ***F01M 9/10*** | (2006.01) |
| ***F01C 1/00*** | (2006.01) |
| ***F04B 43/08*** | (2006.01) |
| ***F02M 69/02*** | (2006.01) |

(Continued)

(52) U.S. Cl.

CPC ..... *F02M 69/02* (2013.01); *F01C 21/0836* (2013.01); *F03C 1/047* (2013.01); *F03C 1/0472* (2013.01); *F04B 1/047* (2013.01); *F04B 1/0472* (2013.01); *F04C 2/3568* (2013.01); *F04C 2210/206* (2013.01)

(58) Field of Classification Search

CPC ..... F04B 1/12; F04B 1/20; F04B 9/04; F04B 9/042; F04B 9/074; F04B 11/005; F04B 11/0075; F04B 19/02; F04B 19/22; F04B 27/08; F04B 27/0804; F04B 35/01; F04B 39/0027

USPC ..... 123/198 C; 418/216–217, 219, 59, 60, 418/228–229

See application file for complete search history.

(56) References Cited

U.S. PATENT DOCUMENTS

| | | | | |
|---|---|---|---|---|
| 3,787,153 | A * | 1/1974 | Williams | 418/176 |
| 4,102,614 | A | 7/1978 | Gold | |

(Continued)

FOREIGN PATENT DOCUMENTS

| | | |
|---|---|---|
| DE | 102009013886 | 9/2010 |
| JP | 42-7217 B1 | 3/1967 |
| JP | 52-132245 | 11/1977 |
| JP | 4-54286 A | 2/1992 |

(Continued)

*Primary Examiner* — Lindsay Low
*Assistant Examiner* — Syed O Hasan
(74) *Attorney, Agent, or Firm* — Sughrue Mion, PLLC

(57) ABSTRACT

A vehicle oil pump having a first member and a second member relatively rotatable around one axial center such that one of them is inserted in an inner circumferential side of the other, includes: a slider member interposed there between in a direction orthogonal to the one axial center, being relatively immovable in circumferential direction around the one axial center with respect to the first member and slidable in a direction parallel to the one axial center. In the vehicle oil pump, a cam groove is formed in a circumferential surface of the second member facing the first member, a projecting portion is disposed on the slider member being fitted in the cam groove, and the cam groove causes the slider member to reciprocate in the one axial center direction in association with rotation of the slider member relative to the second member around the one axial center.

4 Claims, 14 Drawing Sheets

(51) Int. Cl.

| | |
|---|---|
| ***F04B 1/047*** | (2006.01) |
| ***F03C 1/047*** | (2006.01) |
| ***F01C 21/08*** | (2006.01) |
| ***F04C 2/356*** | (2006.01) |

(56) References Cited

U.S. PATENT DOCUMENTS

| | | | | |
|---|---|---|---|---|
| 7,314,354 | B2 * | 1/2008 | Stroganov et al. | 417/477.1 |
| 2007/0025867 | A1 | 2/2007 | Deichmann | |
| 2008/0006237 | A1 | 1/2008 | Page | |

FOREIGN PATENT DOCUMENTS

| | | | |
|---|---|---|---|
| JP | 06-117359 | | 4/1994 |
| JP | 6-43275 | U | 6/1994 |
| JP | 11-50953 | A | 2/1999 |
| JP | 11-210615 | A | 8/1999 |
| JP | 2003-278668 | A | 10/2003 |
| JP | 3587498 | B2 | 11/2004 |
| JP | 3869740 | B2 | 10/2006 |
| JP | 2007504391 | | 3/2007 |
| JP | 2010-144579 | A | 7/2010 |
| WO | 2010/011909 | A2 | 1/2010 |

* cited by examiner

SWITCH

VEHICLE OIL PUMP

CROSS REFERENCE TO RELATED APPLICATIONS

This application is a National Stage of International Application No. PCT/JP2011/058558 filed Apr. 4, 2011, the contents of which are incorporated herein by reference in their entirety.

TECHNICAL FIELD

The present invention relates to a structure of a vehicle oil pump.

BACKGROUND ART

An axial piston pump, an internal gear pump, etc., are well known as a vehicle oil pump. For example, Patent Document 1 discloses the axial piston pump. The axial piston pump of Patent Document 1 is a commonly known oil pump and, for example, according to FIG. 2 of Patent Document 1, the number of pistons included in the axial piston pump is eight.

PRIOR ART DOCUMENT

Patent Document

Patent Document 1: Japanese Laid-Open Patent Publication No. 2010-144579

SUMMARY OF THE INVENTION

Problems to be Solved by the Invention

An axial piston pump as disclosed in Patent Document 1 has a problem of a complicated pump structure and a large pump size with respect to a discharge quantity of the pump. Although hydraulic pulsation is reduced as the number of pistons is increased, the increase in the number of pistons is limited and, therefore, the axial piston has a problem that the hydraulic pulsation is larger as compared to pumps of other types having about the same size such as an internal gear pump, an external gear pump, and a vane pump, for example.

An internal gear pump including a driven gear disposed with internal teeth and a drive gear disposed with external teeth meshed with the internal teeth is frequently used as a vehicle oil pump and the internal gear pump has various problems. For example, a large diameter of the driven gear produces a problem of a large friction loss due to shearing of oil between an outer circumferential surface of the driven gear and side surfaces of the drive gear and the driven gear perpendicular to a pump axial center. In the internal gear pump, because of the rotational drive of the driven gear by the drive gear eccentric with respect to the driven gear and the oil pressure difference between the suction port side and the discharge port side, the driven gear is made eccentric with respect to a rotation axial center, and the eccentricity may problematically deteriorate meshing efficiency between the driven gear and the drive gear and may promote the wearing of the driven gear. Such problems related to the oil pumps are not known.

The present invention was conceived in view of the situations and it is therefore an object of the present invention to provide a vehicle oil pump having a simple structure as compared to an axial piston pump and capable of reducing a loss as compared to an internal gear pump.

Means for Solving the Problem

To achieve the object, the first aspect of the invention provides (a) a vehicle oil pump having a first member and a second member relatively rotatable around one axial center such that one of the first member and the second member is inserted in an inner circumferential side of the other, comprising: (b) a slider member interposed between the first member and the second member in a direction orthogonal to the one axial center, the slider member being relatively immovable in circumferential direction around the one axial center with respect to the first member and slidable in direction parallel to the one axial center, wherein (c) a cam groove is formed in a circumferential surface of the second member facing the first member, wherein a projecting portion disposed on the slider member is fitted in the cam groove, and wherein the cam groove causes the slider member to reciprocate in the one axial center direction in association with rotation of the slider member relative to the second member around the one axial center.

Effects of the Invention

Consequently, with a fewer number of types of components as compared to the axial piston pump, the slider members can be caused to act in the same as piston in the axial piston pump and, thus, the vehicle oil pump can be configured with a simple structure as compared to the axial piston pump. Since the vehicle oil pump of the first aspect of the invention has the first member and the second member not eccentrically arranged with respect to each other and does not include a place corresponding to the outer circumferential surface and the side surfaces of the driven gear generating the frictional loss due to the shearing of oil in the internal gear pump, the vehicle oil pump can reduce loss as compared to the internal gear pump.

The second aspect of the invention provides the vehicle oil pump recited in the first aspect of the invention, wherein the cam groove causes the slider member to reciprocate in the one axial center direction twice or more each time the first member and the second member rotate once relative to each other. Consequently, this example generates multiple sets of low oil pressure places corresponding to, for example, oil suction portions generated by movement of the slider members in the direction for sucking oil and high oil pressure places corresponding to, for example, oil discharge portions generated by movement of the slider members in the direction for discharging the oil alternately around the one axial center and, therefore, the low oil pressure places and the high oil pressure places are respectively arranged so as to cancel the radial force making the first member and the second member eccentric with respect to each other due to the oil pressure difference between the low oil pressure places and the high oil pressure places. As a result, for example, as compared to the case that each time the first member and the second member rotate once relative to each other, the slider members are caused to reciprocate once, the eccentricity between the first member and the second member due to the oil pressure is suppressed and the deterioration in durability of the first member and the second member can be restrained.

The third aspect of the invention provides the vehicle oil pump recited in the first or second aspect of the invention, wherein the second member is a non-rotating member while the first member is a rotating member rotatable around the one axial center. Consequently, when the first member is rotated around the one axial center, the slider members rotate around the one axial center along with the first member while reciprocating in the one axial center direction. The cam groove disposed in the second member does not rotate. Therefore, each of the suction ports for sucking oil and the discharge ports for discharging oil can be disposed at a given place not rotating around the one axial center. For example, if the first member is a non-rotating member while the second member is a rotating member rotatable around the one axial center, the slider members are caused to reciprocate in place without changing the circumferential positions around the one axial center in association with the rotation of the second member and, therefore, oil is alternately sucked and discharged in the same places of the vehicle oil pump. In this case, a hydraulic circuit connected to this vehicle oil pump needs to have a function of switching flow channels between the time of suction and the time of discharge.

The fourth aspect of the invention provides the vehicle oil pump recited in any one of the first to third aspects of the inventions, wherein (a) a plurality of the slider members are annularly disposed around the one axial center between the first member and the second member, wherein (b) capacities of a plurality of oil chambers surrounded and formed by the first member, the second member, and the slider members are changed by reciprocating movement of the slider members corresponding to a relative rotation angle between the first member and the second member. Consequently, a larger number of the slider members can be disposed to make the pulsation of the discharge oil pressure smaller in the vehicle oil pump.

The fifth aspect of the invention provides the vehicle oil pump recited in any one of the first to fourth aspects of the inventions, wherein (a) the second member is formed with a plurality of the cam grooves, and wherein (b) the vehicle oil pump further comprises a cam groove switching mechanism configured to switch the cam groove in which the projecting portion of the slider member fitted from the plurality of the cam grooves. Consequently, the cam groove switching mechanism can switch the cam groove having the projecting portions of the slider members fitted therein to switch the discharge flow quantity of the vehicle oil pump.

Preferably, (a) the cam groove is continuously extended completely around the one axial center and (b) the position of the cam groove on a cross section including the one axial center varies in the one axial center direction depending on a circumferential angle of the cross section around the one axial center.

Preferably, the cam groove binds the slider members to the axial positions in the one axial center direction corresponding to the circumferential positions of the slider members around the one axial center.

MODE FOR CARRYING OUT THE INVENTION

An example of the present invention will now be described in detail with reference to the drawings.

First Example

Figure 1:
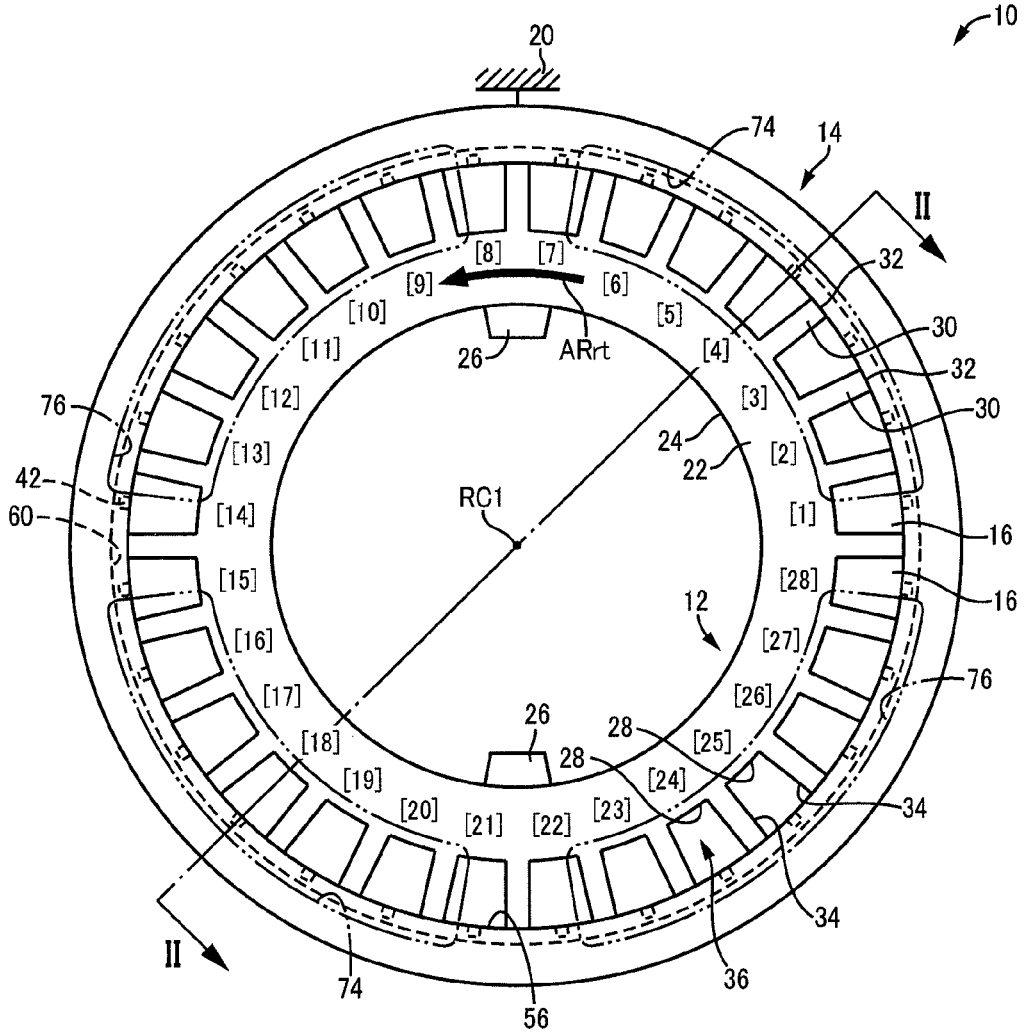
FIG. 1 is a front view of a vehicle oil pump that is an example of the present invention.
Figure 2:
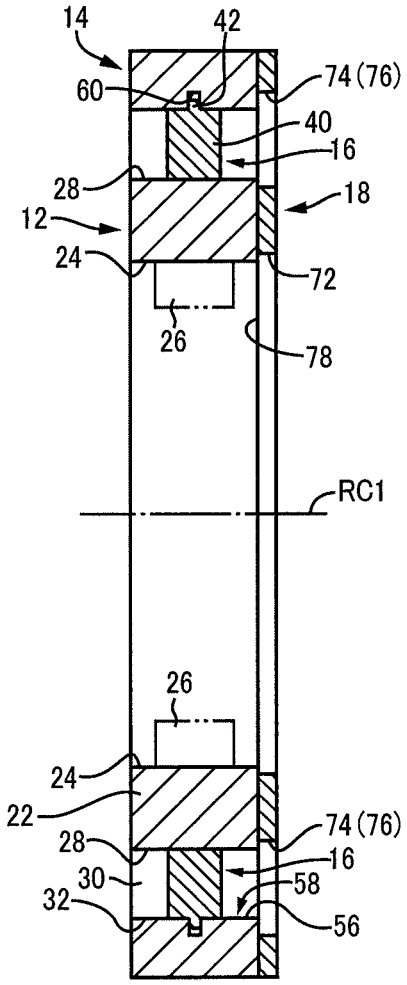
FIG. 2 is a cross-sectional view of the vehicle oil pump taken along and viewed in the direction of arrow II-II of FIG. 1.
Figure 3:
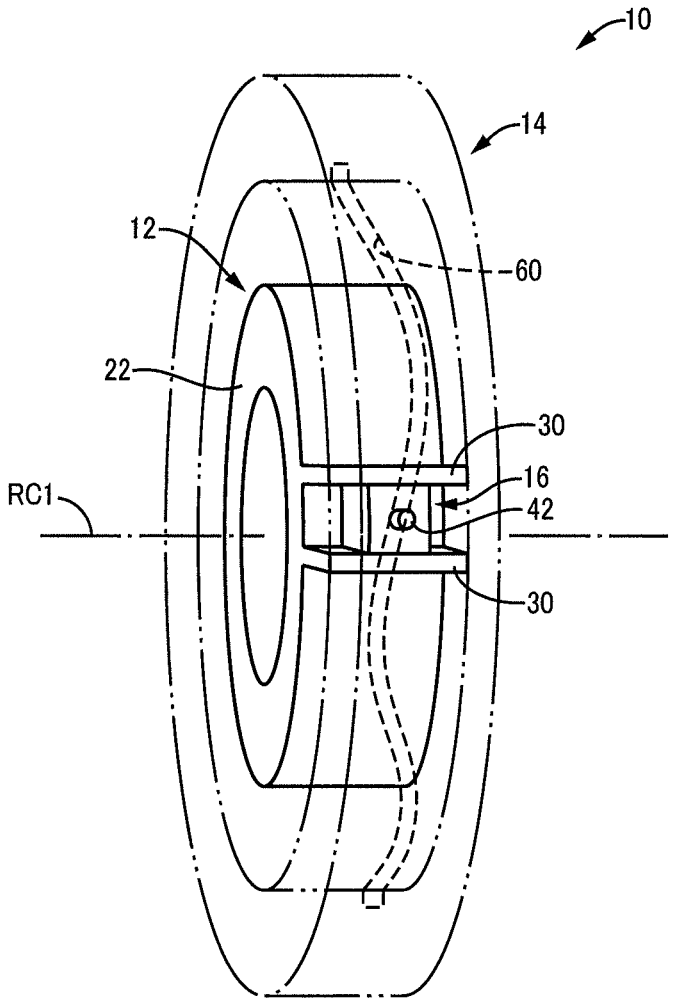
FIG. 3 is a perspective view of the vehicle oil pump of FIG. 1.

FIG. 1 is a front view of a vehicle oil pump 10 that is an example of the present invention. FIG. 2 is a cross-sectional view of the vehicle oil pump 10 taken along and viewed in the direction of arrow II-II of FIG. 1. FIG. 3 is a perspective view of the vehicle oil pump 10. As depicted in FIGS. 1 and 2, the vehicle oil pump 10 includes a pump rotor 12 that is a first member, a pump body 14 that is a second member, a plurality of slider members 16, and a pump cover 18. For example, the vehicle oil pump 10 is an oil pump acting as a hydraulic supply source of a vehicle transmission and is an oil pump attached to an engine and rotationally driven by the engine. That is, the pump body 14 is fixed to a non-rotating member such as a cylinder block 20 of the engine and the pump rotor 12 is rotated around a pump axial center RC1 by a drive shaft such as a crankshaft of the engine, thereby causing the vehicle oil pump 10 to act as an oil pump. The pump axial center RC1 corresponds to one axial center of the present invention.

The pump rotor 12 is inserted in the inner circumferential side of the pump body 14 that is a non-rotating member, and is a rotating member rotatable around the pump axial center RC1 relative to the pump body 14. The pump rotor 12 includes a cylindrical rotor body portion 22 having the axial center same as the pump axial center RC1, a pair of locking portions 26 projected in a radial direction from an inner circumferential surface 24 of the rotor body portion 22, and a plurality of rectangular partition portions 30 radially projected from an outer circumferential surface 28 of the rotor body portion 22 around the pump axial center RC1. For example, the drive shaft such as the crankshaft is fitted into a fitting hole defined by the inner circumferential surface 24. The locking portions 26 are fitted into axial key grooves disposed in the drive shaft, thereby coupling the pump rotor 12 relatively non-rotatably to the drive shaft.

The partition portions 30 are disposed to the same number as the number of the slider members 16. In FIG. 1, the numbers of the slider members 16 and the partition portions 30 are both 28. The plurality of the partition portions 30 are circumferentially arranged at regular angular intervals around the pump axial center RC1. A cylinder around the pump axial center RC1 is defined by connecting all tip surfaces 32 of the plurality of the partition portions 30. Each of the tip surfaces 32 faces an inner circumferential surface 56 of the pump body 14 so that the pump rotor 12 is fitted to the inner circumferential side of the pump body 14 in a rotatable manner.

Figure 4:
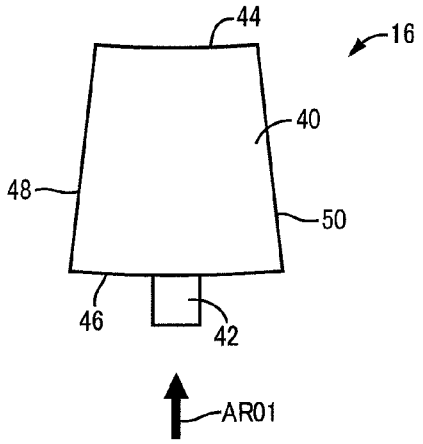
FIG. 4 is a front view of the slider member viewed in the direction of pump axial center of the vehicle oil pump of FIG. 1.
Figure 5:
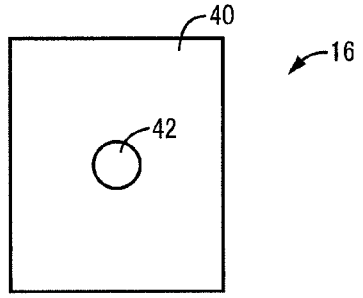
FIG. 5 is a side view of the slider member viewed in the direction of arrow AR01 of FIG. 4.
Figure 6:
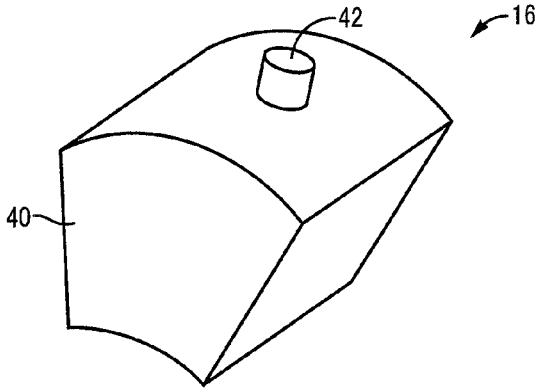
FIG. 6 is a perspective view of the slider member depicted in FIG. 4 and FIG. 5.

A plurality of the slider members 16 are interposed between the pump rotor 12 and the pump body 14 in the direction orthogonal to the pump axial center RC1 and are annularly disposed around the pump axial center RC1 between the pump rotor 12 and the pump body 14. Specifically, each of the plurality of the slider members 16 is fitted into a sliding groove 36 defined by side surfaces 34 of the adjacent and opposed partition portions 30 and the outer circumferential surface 28 of the pump rotor 12. In particular, the slider members 16 are relatively immovable in a circumference direction around the pump axial center RC1 and slidable in a direction parallel to the pump axial center RC1 with respect to the pump rotor 12. A specific shape of the slider member 16 is as depicted in FIGS. 4 to 6. FIG. 4 is a front view of the slider member 16 viewed in the pump axial center RC1 direction; FIG. 5 is a side view of the slider member 16 viewed in the direction of arrow AR01 of FIG. 4; and FIG. 6 is a perspective view of the slider member 16. As depicted in FIGS. 4 to 6, the slider member 16 includes a piston portion 40 fitted into the sliding groove 36 of the pump rotor 12, and a column-shaped projecting portion 42 projecting from the piston portion 40 to the outer circumferential side around the pump axial center RC1. The piston portion 40 has a fan shape in the front view of FIG. 4. Among four side surfaces of the piston portion 40 parallel to the pump axial center RC1, an inner circumferential side surface 44 closest to the pump axial center RC1 faces and slides on the outer circumferential surface 28 of the pump rotor 12 and an outer circumferential side surface 46 on the far side from the pump axial center RC1 faces and slides on the inner circumferential surface 56 of the pump body 14 while remaining two circumferential side surfaces 48 and 50 face and slide on the respective side surfaces 34 of the partition portions 34. To allow the slider member 16 to smoothly slide, the length of the piston portion 40 in the pump axial center RC1 direction is preferably longer than both the circumferential length of the piston portion 40 around the pump axial center RC1 and the radial length of the piston portion 40 orthogonal to the pump axial center RC1.

The projecting portion 42 of the slider member 16 projects from a center part of the outer circumferential side surface 46 as depicted in FIG. 5, for example. Although the piston portion 40 and the projecting portion 42 of the slider member 16 may be made up of one component, the portions may be manufactured as separate components and assembled to each other to make up the slider member 16.

Returning to FIGS. 1 to 3, the pump body 14 is a non-rotating member fixed to the cylinder block 20 of the engine, for example. The pump body 14 is formed with a rotor fitting hole 58 defined by the cylindrical inner circumferential surface 56 around the pump axial center RC1. Into the rotor fitting hole 58, the pump rotor 12 is fitted rotatably around the pump axial center RC1 along with a plurality of the slider members 16. When the pump rotor 12 rotates relative to the pump body 14, the tip surfaces 32 of the plurality of the partition portions 30 included in the pump rotor 12 and the outer circumferential side surfaces 46 of the piston portions 40 included in the plurality of the slider members 16 circumferentially slide around the pump axial center RC1 relative to the inner circumferential surface 56 of the pump body 14.

The inner circumferential surface 56 of the pump body 14 is formed with a cam groove 60 smoothly and continuously extended completely around the pump axial center RC1. As depicted by a broken line in FIG. 3, the cam groove 60 is extended along a wave-like locus reciprocating in the pump axial center RC1 direction depending on a circumferential position around the pump axial center RC1. In other words, the position of the cam groove 60 on a cross section including the pump axial center RC1 varies in the pump axial center RC1 direction depending on a circumferential angle of the cross section around the pump axial center RC1. The cam groove 60 acts as a guide groove guiding the slider members 16 and each of the projecting portions 42 disposed on the slider members 16 is fitted in the cam groove 60. For simplicity of illustration, FIG. 3 only depicts the one slider member 16 and the two partition portions 30 adjacent thereto out of a multiplicity of the partition portions 30 and a multiplicity of the slider members 16. Details of the cam groove 60 will be described later with reference to FIG. 7.

The pump cover 18 is fixed to the pump body 14 and is, for example, a flat-plate-shaped cover member covering the pump rotor 12, a plurality of the slider members 16, and the pump body 14 in one of the pump axial center RC1 directions.

The pump cover 18 is disposed with a through-hole 72 so as not to interfere with the drive shaft coupled to the pump rotor 12. The pump cover 18 has suction ports 74 for sucking oil and discharge ports 76 for discharging oil alternately arranged at regular intervals around the pump axial center RC1 direction on the piston portions 40 of the slider members 16 in the pump axial center RC1 direction, and the suction ports 74 and the discharge ports 76 form opening portions that are partially open. In this example, the slider members 16 reciprocate twice in the pump axial center RC1 direction per rotation of the pump rotor 12 (see FIG. 7) and, therefore, as depicted in FIG. 1, the two suction ports 74 and the two discharge ports 76 are disposed. In this example, the rotor body portion 22 and the partition portions 30 of the pump rotor 12 are disposed in close vicinity to an inner side surface 78 of the pump cover 18 facing the pump rotor 12 to the extent that the pump rotor 12 is not inhibited from rotating around the pump axial center RC1 relative to the pump cover 18; however, the rotor body portion 22 and the partition portions 30 may be slidable around the pump axial center RC1 relative to the inner side surface 78.

Figure 7:
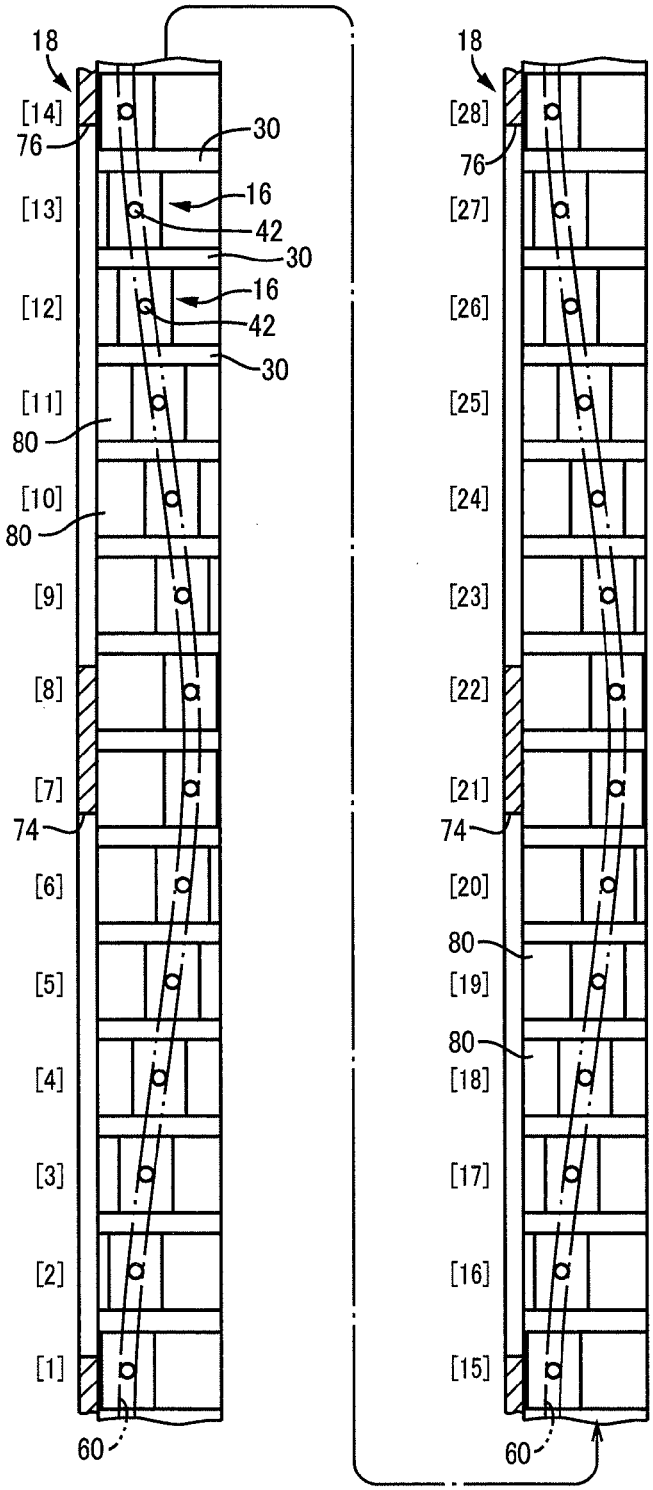
FIG. 7 is a development view of respective axial positions of the slider members in the pump axial center direction when one round of a plurality of the slider members annularly disposed as depicted in FIG. 1 is linearly developed.

FIG. 7 is a development view of respective axial positions of the slider members 16 in the pump axial center RC1 direction when one round of a plurality of the slider members 16 annularly disposed as depicted in FIG. 1 is linearly developed. Positions [1] to [28] are circumferential positions around the pump axial center RC1 depicted in FIG. 7 and represent the positions of the same numbers depicted in FIG. 1. As depicted in FIG. 7, since the projecting portions 42 of the slider members 16 are fitted in the cam groove 60 of the pump body 14, the slider members 16 are bound by the cam groove 60 to the axial positions corresponding to the circumferential positions of the slider members 16 around the pump axial center RC1. That is, the cam groove 60 causes the slider members 16 to reciprocate in the pump axial center RC1 direction as the slider members 16 rotate relative to the pump body 14 around the pump axial center RC1. The cam groove 60 is preferably formed such that each time the pump rotor 12 and the pump body 14 rotate once relative to each other, the slider members 16 are caused to reciprocate twice or more in the pump axial center RC1 direction and, in this example, as depicted in FIG. 7, the cam groove 60 is formed to cause the slider members 16 to reciprocate twice.

Describing the operation of the slider members 16 of FIG. 7 taking as an example the case that the pump rotor 12 rotates in the direction of arrow ARrt in FIG. 1, i.e., in the forward direction, at the positions [1] to [7] and the positions [15] to [21], the slider members 16 move away from the pump cover 18 as the pump rotor 12 rotates. Therefore, as the pump rotor 12 rotates, capacities are expanded in oil chambers 80 surrounded and formed by the pump rotor 12, the pump body 14, and the slider members 16 between the pump cover 18 and the slider members 16 and, as a result, oil is sucked from the suction ports 74 into the oil chambers 80.

At positions [8] to [14] and positions [22] to [28], the slider members 16 move closer to the pump cover 18 as the pump rotor 12 rotates. Therefore, as the pump rotor 12 rotates, capacities are reduced in the oil chambers 80 and, as a result, the oil is discharged from the oil chamber 80 toward the discharge ports 76. Because of such operation of the slider member 16, the suction ports 74 are disposed to open at the circumferential positions around the pump axial center RC1 at which the slider members 16 suck the oil into the oil chambers 80, for example, at the positions [1] to [7] and the positions [15] to [21] of FIGS. 1 and 7. The discharge ports 76 are disposed to open at the circumferential positions around the pump axial center RC1 at which the slider members 16 discharge the oil from the oil chambers 80, for example, at the positions [8] to [14] and the positions [22] to [28] of FIGS. 1 and 7. In short, since the slider members 16 reciprocate twice per rotation of the pump rotor 12 and an oil suction/discharge process is performed twice per rotation of the pump rotor 12, the vehicle oil pump 10 has the two suction ports 74 and the two discharge ports 76 in place. As can be seen from the above, the number of times of reciprocation of the slider members 16 per rotation of the pump rotor 12 is the same as the number of dispositions of each of the suction port 74 and the discharge port 76. As described with reference to FIG. 7, the capacities of the oil chambers 80 are changed due to the reciprocating movement of the slider members 16 corresponding to the relative rotation angle between the pump rotor 12 and the pump body 14 and, therefore, the vehicle oil pump 10 is caused to act as a pump by rotationally driving the pump rotor 12.

Figure 8A:
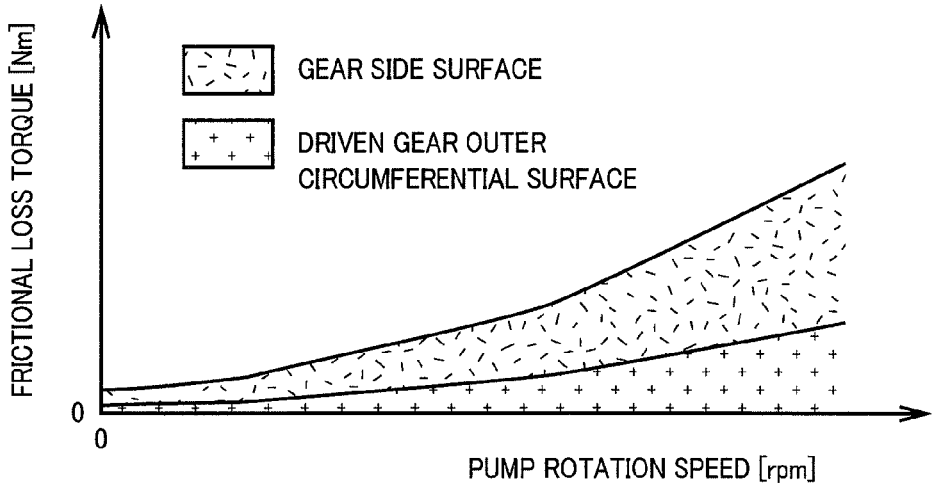
FIG. 8 is a graph of relationship between frictional loss due to shearing of oil and pump rotation speed in each of a conventional internal gear pump and the vehicle oil pump of the first example depicted in FIG. 1, and FIG. 8 (*a*) is a graph of the internal gear pump and FIG. 8 (*b*) is a graph of the vehicle oil pump of the first example.
Figure 8B:
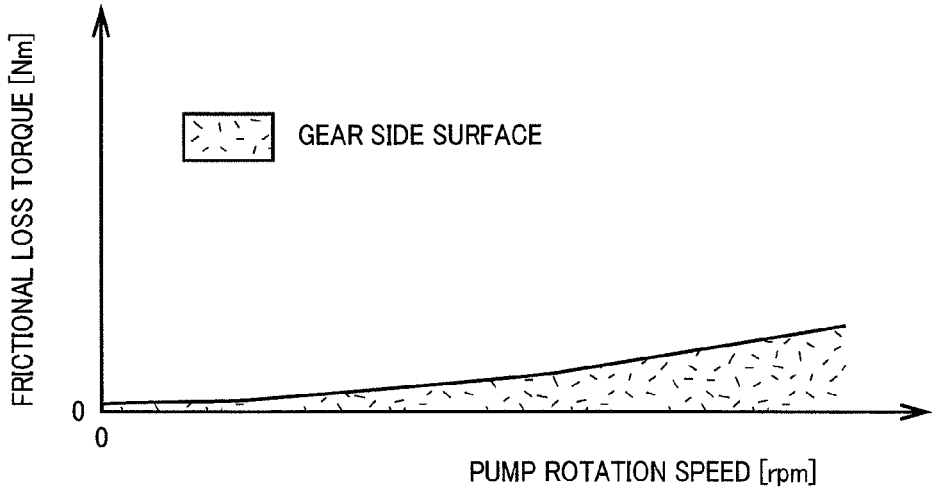
Figure 9:
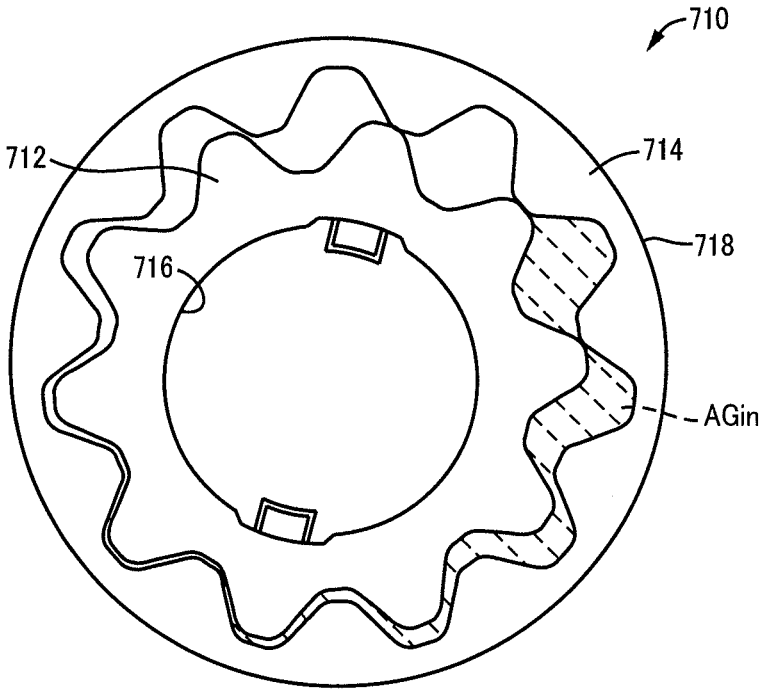
FIG. 9 is a schematic of the internal gear pump having the relationship between the frictional loss and the pump rotation speed depicted in FIG. 8.

Advantages of the vehicle oil pump 10 of this example over a conventional oil pump will then be described. FIG. 8 is a graph of relationship between frictional loss (e.g., in Nm) due to shearing of oil and pump rotation speed in each of a conventional internal gear pump 710 and the vehicle oil pump 10 of this example. FIG. 8(*a*) depicts relationship between the frictional loss and the pump rotation speed in the internal gear pump 710 and FIG. 8(*b*) depicts relationship between the frictional loss and the pump rotation speed in the vehicle oil pump 10. The vertical and horizontal axes of FIG. 8(*a*) and the vertical and horizontal axes of FIG. 8(*b*) are depicted in the same scale with each other so as to enable comparison. FIG. 9 is a schematic of the internal gear pump 710 having the relationship between the frictional loss and the pump rotation speed depicted in FIG. 8. The internal gear pump 710 of FIG. 9 is a typical internal gear pump and includes a drive gear 712 having external teeth and a driven gear 714 having internal teeth meshed with the external teeth. Into a shaft through-hole 716 of the drive gear 712, a drive shaft driving the pump is fitted relatively non-rotatably to the drive gear 712. When the drive gear 712 is rotationally driven by the drive shaft, the driven gear 714 is rotated by the drive gear 712 and the internal gear pump 710 acts as a pump.

In FIG. 8, for proper mutual comparison between FIG. 8(*a*) and FIG. 8(*b*), the vehicle oil pump 10 and the internal gear pump 710 respectively have the theoretical discharge quantities of the both pumps 10 and 710, the axial widths of the pump rotor 12 and the drive gear 712, and the diameter of the inner circumferential surface 24 of the pump rotor 12 and the diameter of the shaft through-hole 716 set to the same values. In FIG. 8(*a*), frictional loss, i.e., frictional loss torque, of a "driven gear outer circumferential surface" is calculated from the following Equation (1) as $L_1$ (in Nm). In FIG. 8(*a*), frictional loss (frictional loss torque) of a "gear side surface" is the sum of friction loss $L_2$ (in Nm) of a side surface of the driven gear 714 calculated from the following Equation (2) and friction loss $L_3$ (in Nm) of a side surface of the drive gear 712 calculated from the following Equation (3). The respective side surfaces of the driven gear 714 and the drive gear 712 are surfaces thereof perpendicular to the axial direction. The frictional loss torque of the "gear side surface" of FIG. 8(*b*) is frictional loss torque (in Nm) on the side surface of the pump rotor 12 facing the inner side surface 78 of the pump cover 18 due to the shearing of oil between the pump rotor 12 and the pump cover 18.

$$L_1=(\pi\times\mu\times n^2)/(1800\times10200)\times(Z_1/Z_2)\times B\times D^3/Sn \quad (1)$$

$$L_2=(\pi\times\mu\times n^2)/(1800\times10200)\times(Z_1/Z_2)\times(D^4-Df_2^4)/(8\times Sa) \quad (2)$$

$$L_3-(\pi\times\mu\times n^2)/(1800\times10200)\times(Dp_1^4-Df_1^4)/(8\times Sa) \quad (3)$$

In Equations (1) to (3), μ is the viscosity (in kgf·s/cm$^2$) of oil; n is the rotation speed (in rpm) of the drive gear 712; $Z_1$ is the number of teeth of the drive gear 712; $Z_2$ is the number of teeth of the driven gear 714; B is the tooth width (in cm) of the driven gear 714; D is the outer diameter (in cm) of the driven gear 714; Sn is a radial gap, i.e., body clearance (in cm), between an outer circumferential surface 718 (see FIG. 9) of the driven gear 714 and a non-rotating member on which the outer circumferential surface 718 slides; $Df_2$ is a dedendum diameter (in cm) of the driven gear 714; $Df_1$ is a dedendum diameter (in cm) of the drive gear 712; Sa is the axial gap, i.e., side clearance (in cm) between the drive gear 712/the driven gear 714 and the non-rotating member; and $Dp_1$ is the pitch circle diameter (in cm) of the drive gear 712.

Figure 10:
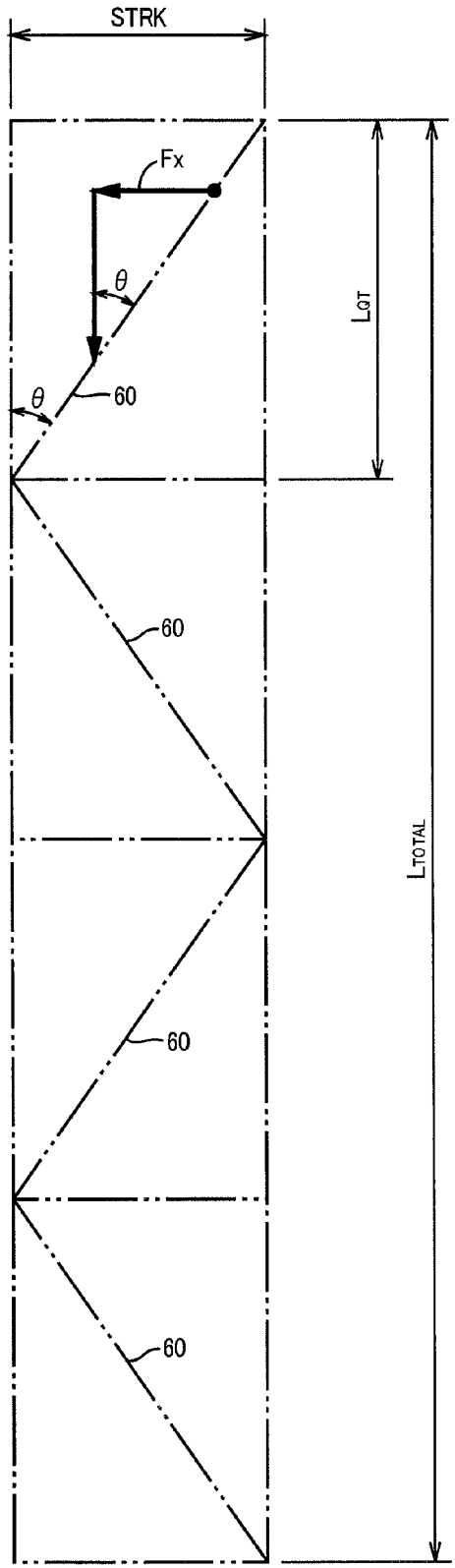
FIG. 10 is a simplified model diagram of the cam groove when one round of the cam groove assumed to have the linear locus around the pump axial center is developed on one plane on the assumption that the cam groove has a linear locus in the vehicle oil pump of FIG. 1.

In the vehicle oil pump 10, when the pump rotor 12 rotates, the slider members 16 slide relative to the pump rotor 12 and the pump body 14 and, therefore, friction loss occurs due to the shearing of oil on the sliding surfaces of the slider members 16. Therefore, to simply calculate the friction loss torque generated on the sliding surfaces of the slider members 16, the friction loss torque generated on the sliding surfaces is calculated on the assumption that the smoothly curved cam groove 60 has a linear locus as depicted in FIG. 10. FIG. 10 is a simplified model diagram of the cam groove 60 when one round of the cam groove 60 assumed to have the linear locus around the pump axial center RC1 is developed on one plane. In FIG. 10, $L_{TOTAL}$ denotes a total length of one round of the cam groove 60 around the pump axial center RC1; STRK denotes amplitude of the cam groove 60 in the pump axial center RC1 direction, i.e., a pump axial center RC1 direction stroke of the slider members 16; $L_{QT}$ denotes a ¼ length of the total length $L_{TOTAL}$, i.e., a circumferential length corresponding to the stroke STRK; θ denotes an angle of the cam groove 60, i.e., a groove angle, relative to the plane perpendicular to the pump axial center RC1; and Fx denotes a pump axial center RC1 direction component of frictional force generated on the sliding surfaces of the slider members 16. As a result of calculation of the frictional loss torque generated on the sliding surfaces of the slider members 16 on the assumption of the cam groove 60 as depicted in FIG. 10, the frictional loss torque is an extremely small value and therefore is not depicted in FIG. 8(*b*). Since the vehicle oil pump 10 does not have a place corresponding to the outer circumferential surface of the driven gear 714 of the internal gear pump 710 and, therefore, FIG. 8(*b*) does not depict the frictional loss torque generated at the place corresponding to the outer circumferential surface of the driven gear 714.

Figure 11:
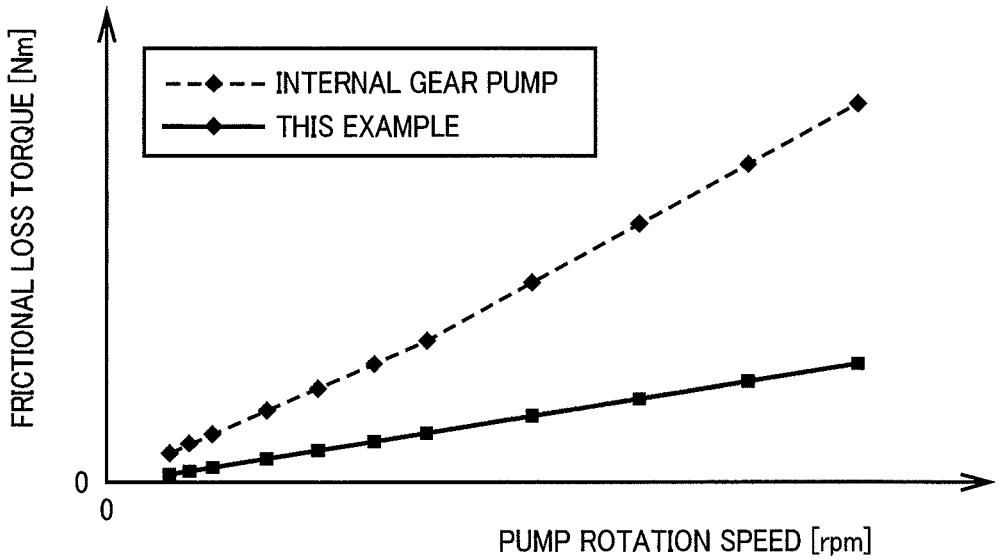
FIG. 11 is a diagram of a graph indicative of the relationship between the frictional loss torques and the pump rotation speed depicted in FIGS. 8(*a*), 8(*b*) regarding the conventional internal gear pump and the vehicle oil pump of the first example depicted in FIG. 1.

Although the frictional loss torques of the vehicle oil pump 10 and the internal gear pump 710 may be compared with each other by comparing FIG. 8(*a*) and FIG. 8(*b*), the relationship between the frictional loss torques of the both pumps 10, 710 depicted in FIGS. 8(*a*), 8(*b*) and the pump rotation speed is represented in one graph, i.e., FIG. 11 to make the comparison easier. In FIG. 11, as can be seen from comparison of the frictional loss torques of the both pumps 10, 710 with each other, the vehicle oil pump 10 of this example can suppress the frictional loss torque due to the shearing of oil to a lower level as compared to the internal gear pump 710. The frictional loss due to the shearing of oil in the vehicle oil pump 10 becomes lower as compared to the internal gear pump 710 as depicted in FIG. 11 because the vehicle oil pump 10 of this example does not have a place corresponding to the side surface and the outer circumferential surface of the driven gear 714 mainly causing the frictional loss in the internal gear pump 710. Another reason is that since the vehicle oil pump 10 of this example causes the slider members 16 to reciprocate only twice per rotation of the pump rotor 12, the slide speed of the slider members 16 in the pump axial center RC1 direction is extremely small, which makes the frictional loss generated on the sliding surfaces of the slider members 16 extremely small. A further reason is that, as depicted in FIG. 1, the most of the place of the pump cover 18 facing the slider members 16 in the pump axial center RC1 direction is the suction port 74 or the discharge port 76 and is opened in the vehicle oil pump 10 of this example and that almost no friction loss due to the shearing of oil is generated in the suction port 74 and the discharge port 76 even when the pump rotor 12 rotates relative to the pump cover 18. Additionally, since the internal gear pump 710 has the drive gear 712 and the driven gear 714 eccentrically meshed with each other, frictional loss due to meshing between gears also occurs in addition to the friction loss due to the shearing of oil. Therefore, considering the frictional loss due to meshing between gears, i.e., the frictional loss when gears rub against each other, the frictional loss of the internal gear pump 710 further increases from the frictional loss depicted in FIG. 11.

Figure 12:
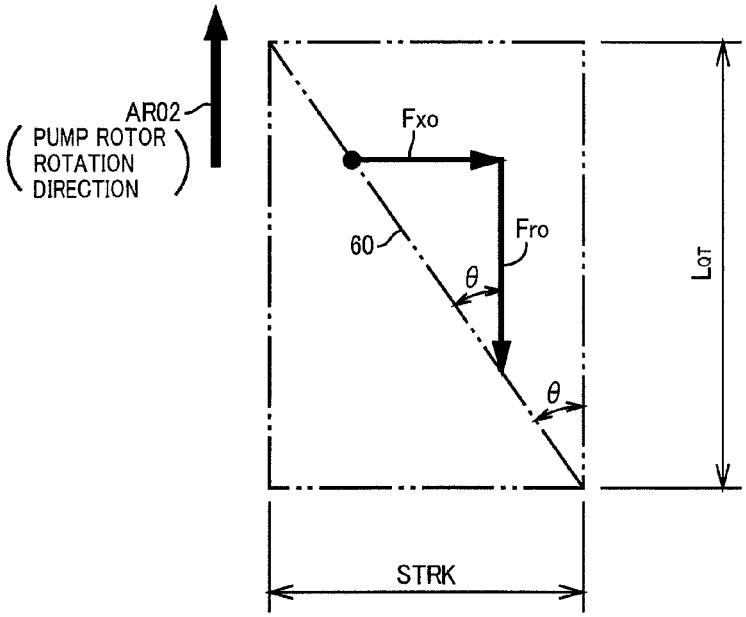
FIG. 12 is a diagram of a drag in the rotation direction of the pump rotor generated by an oil pressure in the vehicle oil pump of FIG. 1 depicted as a portion extracted from the simplified model diagram of FIG. 10.
Figure 13:
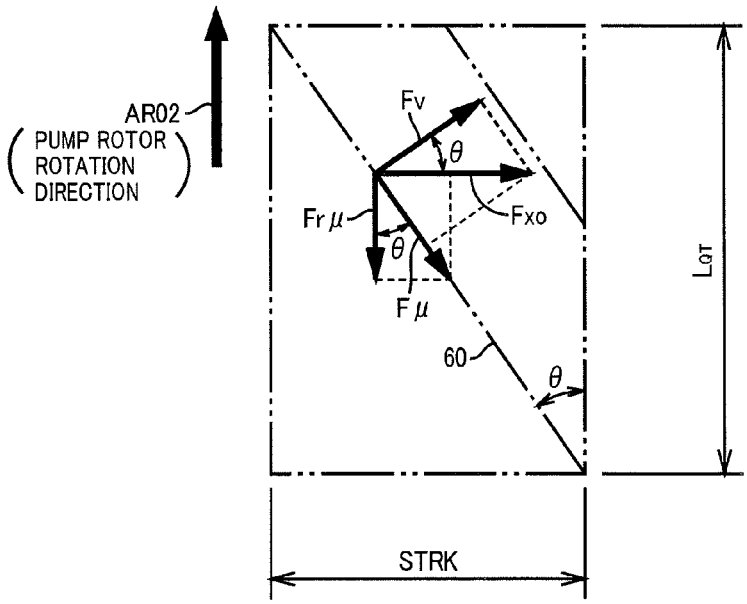
FIG. 13 is a diagram of a drag in the rotation direction of the pump rotor generated by friction between the projecting portion of the slider member and the side surfaces (friction surfaces) of the cam groove on which the projecting portion slides in the vehicle oil pump of FIG. 1 depicted as a portion extracted from the simplified model diagram of FIG. 10.
Figure 14:
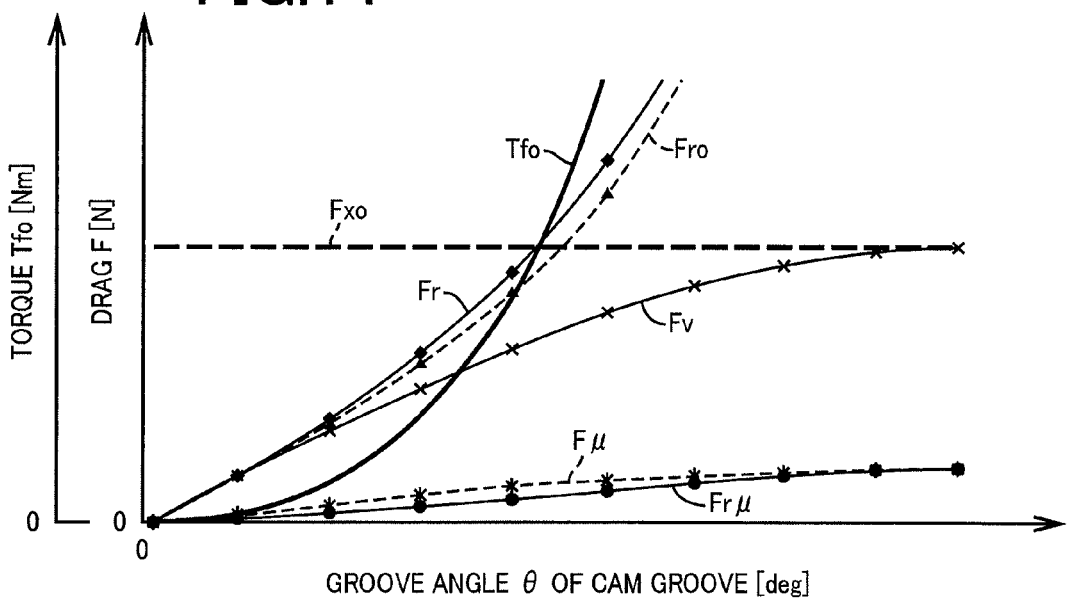
FIG. 14 is a graph of relationship in the vehicle oil pump of FIG. 1 between a groove angle of the cam groove and each of the forces depicted in FIGS. 12 and 13 and a drive torque.

FIG. 12 is a diagram of a drag in the rotation direction of the pump rotor 12 generated by an oil pressure in the vehicle oil pump 10 of this example depicted as a portion extracted from the simplified model diagram of FIG. 10. FIG. 13 is a diagram of a drag in the rotation direction of the pump rotor 12 generated by friction between the projecting portion 42 of the slider member 16 and the side surfaces (friction surfaces) of the cam groove 60 on which the projecting portion 42 slides in the vehicle oil pump 10 of this example depicted as a portion extracted from the simplified model diagram of FIG. 10. FIG. 14 is a graph of relationship between a groove angle θ (see FIG. 10) of the cam groove 60 and each of the forces depicted in FIGS. 12 and 13 and a drive torque Tfo. In FIGS. 12, 13, and 14, STRK, $L_{QT}$, and θ are the same as those used in FIG. 10; arrow AR02 indicates the rotation direction of the pump rotor 12; Fxo denotes a force in the pump axial center RC1 direction (the discharge side is the forward direction) applied to the slider member 16; Fro depicts a pump rotor rotation direction drag of a force due to an oil pressure in the oil chamber 80; Fv depicts a friction surface normal reaction perpendicular to the friction surface of the cam groove 60; μA denotes a dynamic friction coefficient between the cam groove 60 and the projecting portion 42 (dynamic friction coefficient between steel and steel); FμA denotes a dynamic frictional force along the cam groove 60; Frμ denotes a pump rotor rotation direction component of the dynamic frictional force Fμ, i.e., a pump rotor rotation direction drag of a force due to friction; and Tfo denotes a drive torque required for rotationally driving the vehicle oil pump 10. Since the drive torque Tfo of the vehicle oil pump 10 is mainly opposed to a reaction torque due to oil pressure and a reaction torque due to friction between the cam groove 60 and the projecting portion 42, the drive torque Tfo is calculated as the sum of the pump rotor rotation direction drag Fro of force due to the oil pressure and the pump rotor rotation direction drag Frμ of force due to the friction (Tfo=Fro+Frμ). As depicted in FIG. 14, the vehicle oil pump 10 of this example requires a larger drive torque Tfo when the groove angle θ of the cam groove 60 is larger.

Figure 15:
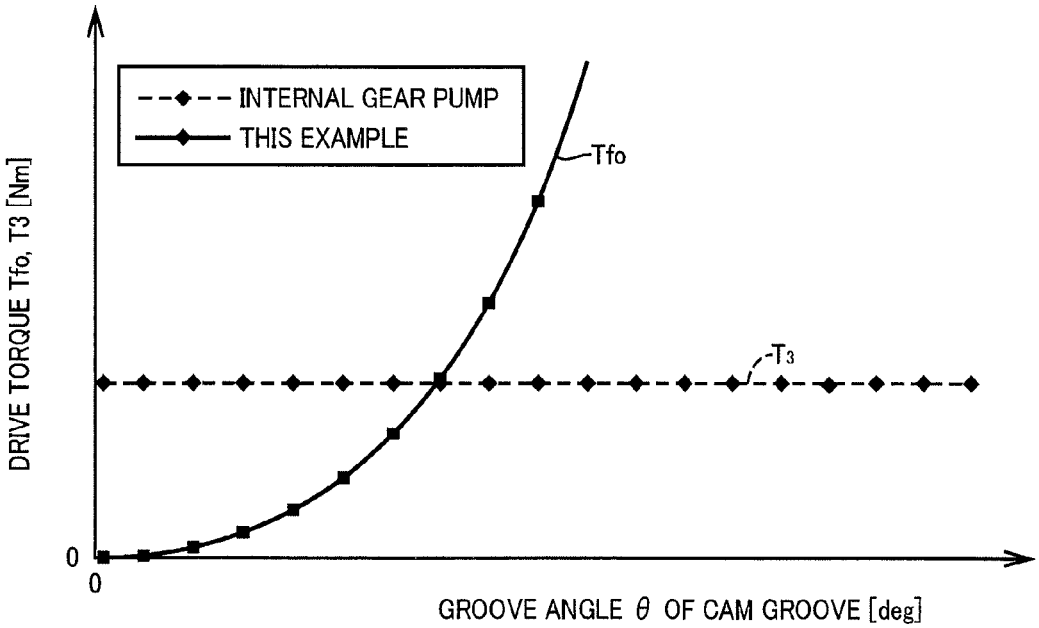
FIG. 15 is a graph of relationship between the drive torque of a pump and the groove angle of the cam groove depicted for the internal gear pump of FIG. 9 and the vehicle oil pump of the first example depicted in FIG. 1.

The vehicle oil pump 10 of this example and the conventional internal gear pump 710 of FIG. 9 will be compared in terms of the drive torque of a pump. FIG. 15 is a diagram for this purpose. FIG. 15 is a graph of relationship between the drive torque of a pump and the groove angle θ of the cam groove 60 depicted for the internal gear pump 710 of FIG. 9 and the vehicle oil pump 10 of this example. In FIG. 15, for proper mutual comparison, the vehicle oil pump 10 and the internal gear pump 710 respectively have the theoretical discharge quantities, discharge pressures, and suction pressures of the both pumps 10 and 710 set to the same values. The drive torque Tfo of the vehicle oil pump 10 depicted in FIG. 15 is the same as that of FIG. 14. In FIG. 15, since the internal gear pump 710 does not have the groove angle θ of the cam groove 60, the drive torque of the internal gear pump 710 is indicated by a constant value and, specifically, the drive torque of the internal gear pump 710 is calculated from the following Equation (4). In the following Equation (4), $T_3$ is the drive torque (in Nm) of the internal gear pump 710; ΔP is an oil pressure difference between discharge pressure and suction pressure (=discharge pressure−suction pressure), i.e., a difference pressure (in kgf/cm$^2$); Q is a discharge quantity (in cm$^3$/s) of the internal gear pump 710; and N is a rotation speed (in rpm) of the drive gear 712.

$$T_3=(30\times\Delta P\times Q)/(\pi\times N)\times 9.8\times 10^{-2} \quad (4)$$

As depicted in FIG. 15, the vehicle oil pump 10 of this example requires a larger drive torque Tfo when the groove angle θ of the cam groove 60 is larger. However, it is known from FIG. 15 that the drive torque Tfo of the vehicle oil pump 10 can be reduced in the vehicle oil pump 10 as compared to the internal gear pump 710 by setting the groove angle θ of the cam groove 60 equal to or less than a predetermined angle at which the drive torque Tfo of the vehicle oil pump 10 exceeds the drive torque $T_3$ of the internal gear pump 710.

Figure 16:
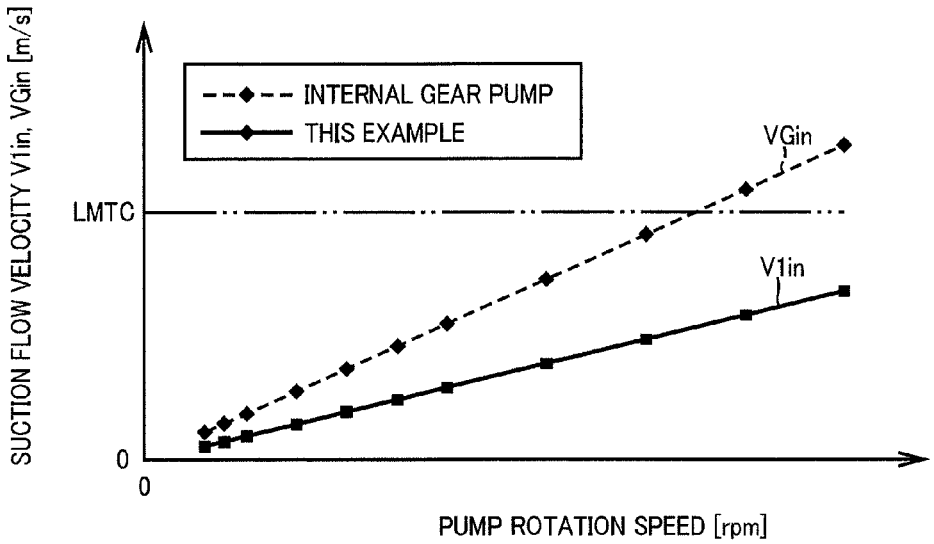
FIG. 16 is a graph of relationship between a pump rotation speed and a pump suction flow velocity in each pump for comparing anti-cavitation performance between the vehicle oil pump of the first example depicted in FIG. 1 and the internal gear pump 710 of FIG. 9.

FIG. 16 is a graph of relationship between a pump rotation speed (in rpm) and a pump suction flow velocity (in m/s) in each pump for comparing anti-cavitation performance between the vehicle oil pump 10 of this example and the internal gear pump 710 of FIG. 9. In FIG. 16, an upper limit suction flow velocity capable of avoiding cavitation, i.e., a cavitation limit flow velocity is denoted by LMTC. In FIG. 16, for proper mutual comparison, the vehicle oil pump 10 and the internal gear pump 710 respectively have the theoretical discharge quantities of the both pumps 10 and 710, the axial widths of the pump rotor 12 and the drive gear 712, and the diameter of the inner circumferential surface 24 of the pump rotor 12 and the diameter of the shaft through-hole 716 set to the same values. A suction flow velocity VGin of the internal gear pump 710 is calculated by dividing a suction flow quantity QGin (in m$^3$/s) by a suction area AGin (a shaded portion with broken lines of FIG. 9) perpendicular to the axial direction contributed to suction of oil between the outer teeth of the drive gear 712 and the inner teeth of the driven gear 714 (VGin=QGin/AGin). With regard to the vehicle oil pump 10 of this example, the slide speed in the pump axial center RC1 direction of the slider members 16 is calculated based on that the slider members 16 reciprocate twice per rotation of the pump rotor 12 and the stroke amount STRK of the slider members 16 in the pump axial center RC1 direction, and a suction flow velocity V1in of the vehicle oil pump 10 is considered equal to the slide speed. Comparing the suction flow velocities V1in and VGin of the both pumps 10 and 710 calculated as described above in FIG. 16, the suction flow velocity V1in of the vehicle oil pump 10 of this example is smaller than the suction flow velocity VGin of the internal gear pump 710 and therefore has a larger margin to the cavitation limit flow velocity LMTC. A difference of suction flow velocity (=VGin−V1in) of the both pumps 10 and 710 expands as the pump rotation speed becomes higher. Therefore, the vehicle oil pump 10 of this example is advantageous over the internal gear pump 710 in terms of the anti-cavitation performance. For example, since the vehicle oil pump 10 can be driven at higher speed while avoiding cavitation as compared to the internal gear pump 710, the vehicle oil pump 10 is advantageously easily reduced in size.

When the vehicle oil pump 10 of this example is compared with pumps of other structures, for example, the internal gear pump 710 of FIG. 9 and an axial piston pump, on the assumption that the respective theoretical discharge quantities are the same and that the pump sizes are substantially the same, the vehicle oil pump 10 is also advantageous in terms of hydraulic pulsation performance of discharge pressure. Therefore, the vehicle oil pump 10 can suppress discharge pressure pulsation to a smaller level as compared to the pumps of other structures. This is because when the number of individual oil chambers containing oil per rotation of a pump rotor is larger, i.e., when the number of the oil chambers 80 is larger in the case of this example, the discharge pressure pulsation is made smaller. Specifically, this is because the number of the oil chambers 80 is 28 in the vehicle oil pump 10 and, if the same structure as the vehicle oil pump 10 is employed, the number of the disposed oil chambers 80 can be made considerably larger than the number of teeth of the drive gear 712 of the internal gear pump 710 corresponding to the number of the individual oil chambers and the number of pistons of the axial piston pump corresponding to the number of the individual oil chambers.

Figure 17:
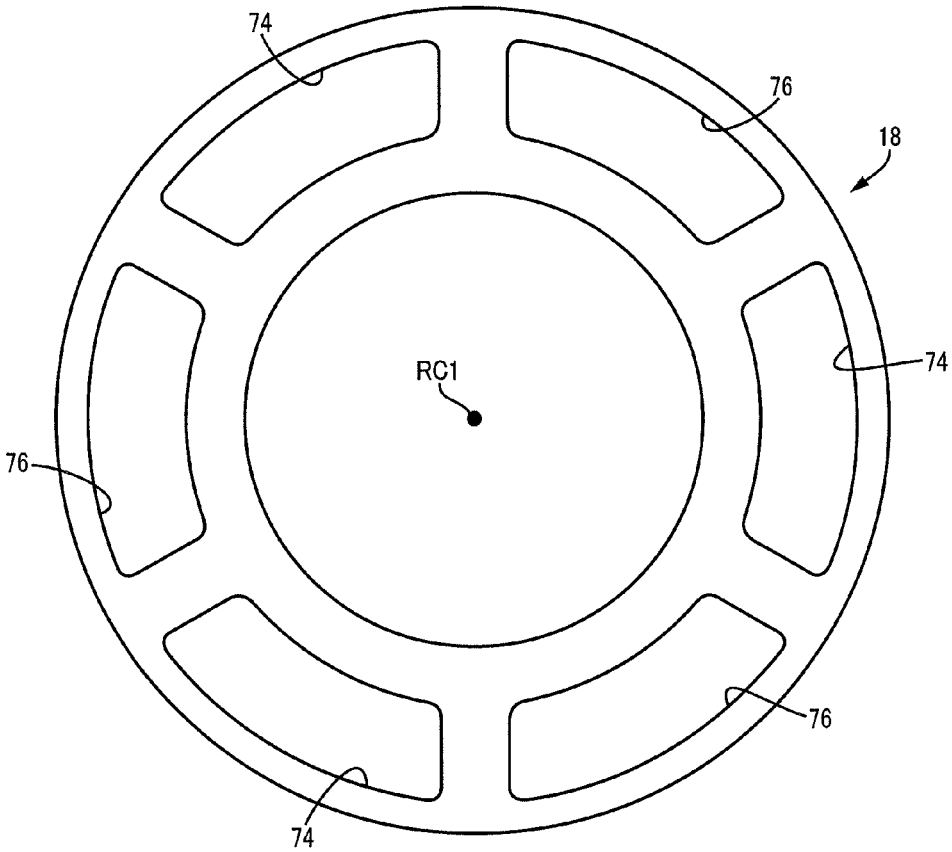
FIG. 17 is a diagram illustrative of the arrangement of the suction ports and the discharge ports on the assumption that a total of three sets of the suction ports and the discharge ports are present in the vehicle oil pump of FIG. 1.

Anti-eccentricity performance of the rotating members of the vehicle oil pump 10 of this example will be described in comparison with the internal gear pump 710 as depicted in FIG. 9, for example. For example, since a pump obviously has larger oil pressure at a discharge port than oil pressure at a suction port, an oil pressure difference between the vicinity of the suction port and the vicinity of the discharge port acts as an eccentric force making the driven gear 714 eccentric in the internal gear pump 710. Since no crescent exists, the eccentric force due to the oil pressure difference makes the driven gear 714 eccentric relative to the original rotation axial center. On the other hand, the drive gear 712 is supported by the drive shaft and therefore is hardly made eccentric. As a result, the meshing between the drive gear 712 and the driven gear 714 deteriorates and the tooth hitting noise tends to occur in the internal gear pump 710. However, since the vehicle oil pump 10 of this example has the suction ports 74 diagonally arranged with the pump axial center RC1 at the midpoint and the discharge ports 76 diagonally arranged with the pump axial center RC1 at the midpoint as depicted in FIG. 1, the oil pressure is well-balanced around the pump axial center RC1 and the oil pressure difference between the vicinity of the suction ports 74 and the vicinity of the discharge ports 76 generates almost no eccentric force to the pump rotor 12. Although a total of two sets of the suction ports 74 and the discharge ports 76 are present in FIG. 1, for example, even if the slider members 16 reciprocate thrice per rotation of the pump rotor 12 and a total of three sets of the suction ports 74 and the discharge ports 76 are present as depicted in FIG. 17, the oil pressure is well-balanced in the same way and the oil pressure difference generates almost no eccentric force to the pump rotor 12. The axial center of the pump rotor 12 and the axial center of the pump body 14 are the same, which is the pump axial center RC1. Therefore, the vehicle oil pump 10 of this example is advantageous in terms of the anti-eccentricity performance of the rotating members over the internal gear pump 710.

The vehicle oil pump 10 of this example has the following effects (A1) to (A4). (A1) According to this example, a plurality of the slider members 16 are relatively immovable in the circumferential direction around the pump axial center RC1 and slidable in the direction parallel to the pump axial center RC1 with respect to the pump rotor 12 and are interposed between the pump rotor 12 and the pump body 14 in the direction orthogonal to the pump axial center RC1. The projecting portions 42 disposed on the slider members 16 are fitted into the cam groove 60 and the cam groove 60 causes the slider members 16 to reciprocate in the pump axial center RC1 direction as the slider members 16 rotate relative to the pump body 14 around the pump axial center RC1, and is formed in the inner circumferential surface 56 of the pump body 14 facing the pump rotor 12. Therefore, with a fewer number of types of components as compared to a conventional axial piston pump, the slider members 16 can be caused to act in the same as piston in the axial piston pump and, thus, the vehicle oil pump 10 can be configured with a simple structure as compared to the axial piston pump. Since the vehicle oil pump 10 of this example has the pump rotor 12 and the pump body 14 not eccentrically arranged with respect to each other and does not include a place corresponding to the outer circumferential surface 718 and the side surfaces of the driven gear 714 generating the frictional loss due to the shearing of oil in the internal gear pump 710 exemplarily illustrated in FIG. 9, the vehicle oil pump 10 can reduce power loss as compared to the internal gear pump 710. That is, the vehicle oil pump 10 can efficiently operate as compared to the internal gear pump 710. The vehicle oil pump 10 of this example does not have a component corresponding to the driven gear 714 of the internal gear pump 710 and therefore is easily reduced in size as compared to the internal gear pump 710.

(A2) According to this example, in the pump body 14, the cam groove 60 is formed such that each time the pump rotor 12 and the pump body 14 rotate once relative to each other, the slider members 16 are caused to reciprocate twice or more in the pump axial center RC1 direction. Therefore, this example generates multiple sets of low oil pressure places corresponding to, for example, oil suction portions generated by movement of the slider members 16 in the direction for sucking oil and high oil pressure places corresponding to, for example, oil discharge portions generated by movement of the slider members 16 in the direction for discharging the oil alternately around the pump axial center RC1 and, therefore, the suction ports 74 corresponding to the low oil pressure places and the discharge ports 76 corresponding to the high oil pressure places are respectively arranged so as to cancel the radial force making the pump rotor 12 and the pump body 14 eccentric with respect to each other due to the oil pressure difference between the low oil pressure places and the high oil pressure places (see FIGS. 1 and 17). As a result, for example, as compared to the case that each time the pump rotor 12 and the pump body 14 rotate once relative to each other, the slider members 16 are caused to reciprocate once, the eccentricity between the pump rotor 12 and the pump body 14 due to the oil pressure is suppressed and the deterioration in durability of the pump rotor 12 and the pump body 14 can be restrained.

(A3) According to this example, the pump body 14 formed with the cam groove 60 is a non-rotating member while the pump rotor 12 immovable relative to a plurality of the slider members 16 in the circumferential direction around the pump axial center RC1 is a rotating member rotatable around the pump axial center RC1. Because of such a configuration, when the pump rotor 12 is rotated around the pump axial center RC1, the slider members 16 rotate around the pump axial center RC1 along with the pump rotor 12 while reciprocating in the pump axial center RC1 direction. The cam groove 60 disposed in the pump body 14 does not rotate. Therefore, each of the suction ports 74 for sucking oil and the discharge ports 76 for discharging oil can be disposed at a given place not rotating around the pump axial center RC1. For example, if the pump rotor 12 is a non-rotating member while the pump body 14 is a rotating member rotatable around the pump axial center RC1, the slider members 16 are caused to reciprocate in place without changing the circumferential positions around the pump axial center RC1 in association with the rotation of the pump body 14 and, therefore, oil is alternately sucked and discharged in the same places of the vehicle oil pump 10. In this case, a hydraulic circuit connected to the vehicle oil pump 10 needs to have a function of switching flow channels between the time of suction and the time of discharge.

(A4) According to this example, a plurality of the slider members 16 are annularly disposed around the pump axial center RC1 between the pump rotor 12 and the pump body 14. The capacities of a plurality of the oil chambers 80 surrounded and formed by the pump rotor 12, the pump body 14, and the slider members 16 are changed due to the reciprocating movement of the slider members 16 corresponding to the relative rotation angle between the pump rotor 12 and the pump body 14. Therefore, a larger number of the slider members 16 can be disposed to make the pulsation of the discharge oil pressure smaller in the vehicle oil pump 10.

Another example of the present invention will be described. In the following description of the example, the mutually overlapping portions of the examples will be denoted by the same reference numerals and will not be described.

Second Example

In the description of this example (second example), differences from the first example will mainly be described. Although the first example includes the one cam groove 60, this example includes another cam groove 160 formed in the inner circumferential surface 56 of a pump body 162 in addition to the cam groove 60 of the first example. When the cam grooves are distinguished from each other in the description of this example, the cam groove 60 same as the first example is referred to as a first cam groove 60 and the cam groove 160 newly disposed in this example is referred to as a second cam groove 160. In this example, the pump body 162 is disposed with a cam groove switch mechanism 164 switching the cam groove reciprocating the slider members 16 to either the first cam groove 60 or the second cam groove 160. The pump body 162 of this example is the same as the pump body 14 of the first example except that the second cam groove 160 and the cam groove switch mechanism 164 are included. That is, a vehicle oil pump 150 of this example is the same as the vehicle oil pump 10 of the first example except the second cam groove 160 and the cam groove switch mechanism 164.

Figure 18:
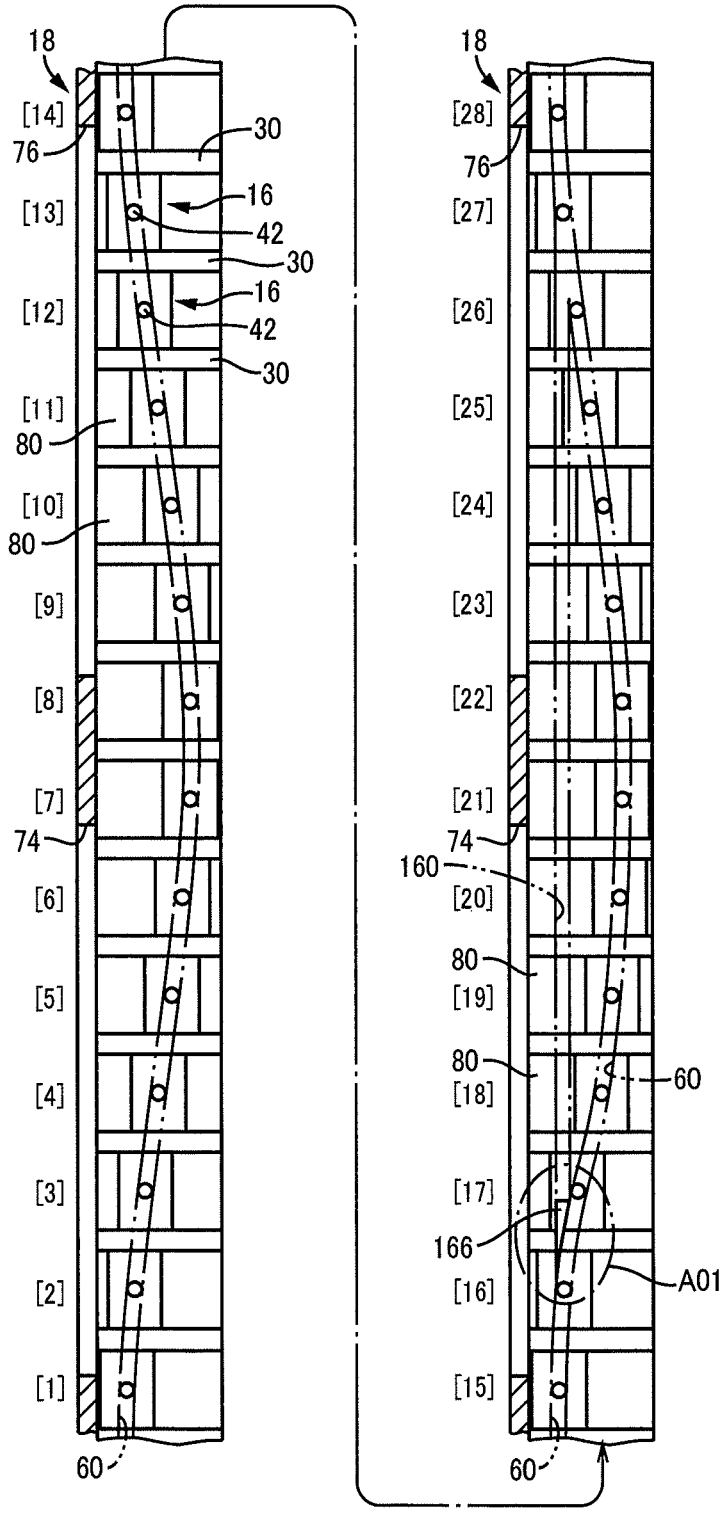
FIG. 18 is a development view similar to FIG. 7 and is a development view of respective axial positions of the slider members in the pump axial center direction when one round of a plurality of the slider members annularly disposed in the vehicle oil pump of the second example is linearly developed.
Figure 19A:
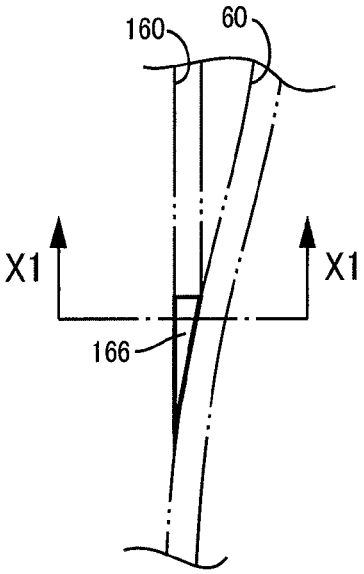
FIG. 19 is an enlarged view of a portion surrounded by a dashed-dotted line A01 of FIG. 18 and FIG. 19(*a*) depicts the switching position of the cam groove switching mechanism same as FIG. 18 i.e. the first switching position while FIG. 19(*b*) depicts a state of the cam groove switching mechanism 164 switched to the other switching position i.e. the second switching position.
Figure 19B:
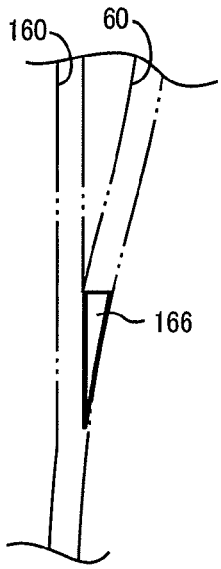
Figure 20:
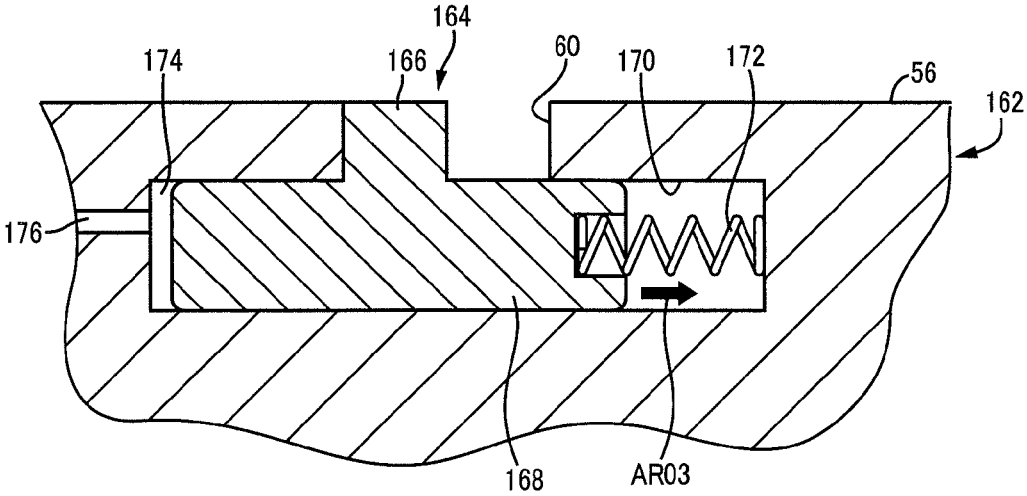
FIG. 20 is a cross-sectional view of the pump body taken along and viewed in the direction of arrow X1-X1 of FIG. 19(*a*).

FIG. 18 is a development view similar to FIG. 7 and is a development view of respective axial positions of the slider members 16 in the pump axial center RC1 direction when one round of a plurality of the slider members 16 annularly disposed around the pump axial center RC1 in the vehicle oil pump 150 is linearly developed. FIG. 19 is an enlarged view of a portion surrounded by a dashed-dotted line A01 of FIG. 18 and FIG. 19(*a*) depicts the switching position of the cam groove switch mechanism 164 same as FIG. 18 while FIG. 19(*b*) depicts a state of the cam groove switch mechanism 164 switched to the other switching position. FIG. 20 is a cross-sectional view of the pump body 162 taken along and viewed in the direction of arrow X1-X1 of FIG. 19(*a*).

As depicted in FIG. 18, the pump body 162 is formed with a plurality of the cam grooves 60 and 160. Specifically, two cam grooves, i.e., the first cam groove 60 and the second cam groove 160 are formed. The second cam groove 160 is formed in a half round of the inner circumferential surface 56 of the pump body 162 such that the position of the second cam groove 160 in a cross section including the pump axial center RC1 does not vary in the pump axial center RC1 direction depending on a circumferential angle of the cross section around the pump axial center RC1. Therefore, while the projecting portions 42 of the slider members 16 are fitted in the second cam groove 160, the slider members 16 do not slide in the pump axial center RC1 direction even when the pump rotor 12 rotates.

As depicted in FIGS. 19 and 20, the cam groove switch mechanism 164 includes a cam groove switching portion 166 blocking one of the first cam groove 60 and the second cam groove 160 and opening the other cam groove so that the projecting portions 42 can be fitted into the cam groove, and a main body portion 168 integrated with the cam groove switching portion 166. The cam groove switch mechanism 164 is switched to one of a first switching position depicted in FIG. 19(*a*) and a second switching position depicted in FIG. 19(*b*) when the main body portion 168 is pushed and moved in the pump axial center RC1 direction by oil pressure or spring force. For example, as depicted in FIG. 20, the main body portion 168 is fitted in a cylinder bore 170 formed in the pump body 162 slidably in the pump axial center RC1 direction. In the cylinder bore 170, a coil spring 172 is disposed on one side (second switching position side) relative to the main body portion 168 in the pump axial center RC1 direction and an oil chamber 174 is formed on the other side (first switching position side). The main body portion 168 is biased by the coil spring 172 toward the side of the oil chamber 174, i.e., the first switching position side. In such a configuration, if an operating oil pressure is not supplied to the oil chamber 174, the main body portion 168 is moved toward the first switching position side by the bias force of the coil spring 172. On the other hand, if the operating oil pressure is supplied via an oil passage 176 to the oil chamber 174 and a pressing force of the operating oil pressure to the main body portion 168 exceeds the bias force of the coil spring 172, the main body portion 168 is moved toward the second switching position side by the pressing force of the operating oil pressure.

Specifically, when the cam groove switch mechanism 164 is switched to the first switching position, the first cam groove 60 is opened such that the projecting portions 42 can be fitted therein while the second cam groove 160 is blocked such that the projecting portions 42 cannot be fitted therein as depicted in FIG. 19(*a*). If the cam groove switch mechanism 164 is switched to the second switching position by, for example, moving the cam groove switching portion 166 and the main body portion 168 in the pump axial center RC1 direction as indicated by arrow AR03 (see FIG. 20), the first cam groove 60 is blocked such that the projecting portions 42 cannot be fitted therein while the second cam groove 160 is opened such that the projecting portions 42 can be fitted therein as depicted in FIG. 19(*b*). In this way, the cam groove switch mechanism 164 switches the cam groove having the projecting portions 42 of the slider members 16 fitted therein to one of a plurality of the cam grooves 60 and 160, or specifically, either the first cam groove 60 or the second cam groove 160. The cam groove switch mechanism 164 of this example is configured based on the premise that the pump rotor 12 rotates in the forward direction (direction of arrow ARrt of FIG. 1).

This example has the following effect (B1) in addition to the effects (A1) to (A4) of the first example. (B1) According to this example, the pump body 162 is formed with a plurality of the cam grooves 60 and 160 and the cam groove switch mechanism 164 switches the cam groove having the projecting portions 42 of the slider members 16 fitted therein to one of a plurality of the cam grooves 60 and 160. Therefore, the cam groove switch mechanism 164 can switch the cam groove having the projecting portions 42 of the slider members 16 fitted therein to switch the discharge flow quantity of the vehicle oil pump 150. For example, if the cam groove switch mechanism 164 is switched to the first switching position, the slider members 16 reciprocate twice per rotation of the pump rotor 12; however, if the cam groove switch mechanism 164 is switched to the second switching position, the second cam groove 160 is enabled and causes the slider members 16 to reciprocate only substantially once per rotation of the pump rotor 12 and, therefore, by switching the cam groove switch mechanism 164 from the first switching position to the second switching position, the discharge quantity of the vehicle oil pump 150 can be substantially halved without changing the rotation speed of the pump rotor 12.

Although the examples of the present invention have been descried in detail with reference to the drawings, these examples merely represent an embodiment and the present invention may be implemented in variously modified and improved forms based on the knowledge of those skilled in the art.

For example, although the piston portion 40 of the slider member 16 has a fan shape in the front view of FIG. 4 in the first and second examples, the outer shape thereof is not limited to the fan shape.

Although the cam groove 60 is formed such that each time the pump rotor 12 and the pump body 14 rotate once relative to each other, the slider members 16 are caused to reciprocate twice in the pump axial center RC1 direction in the first and second examples, the cam groove 60 may be formed such that the slider members 16 are caused to reciprocate once or may be formed such that the slider members 16 are caused to reciprocate thrice or more. The number of times of reciprocation of the slider members 16 per rotation, the numbers of the suction ports 74, and the number of the discharge ports 76 are the same with each other and, for example, if the slider members 16 reciprocate thrice per rotation, the three suction ports 74 and the three discharge ports 76 are disposed in place.

In the first and second examples, as depicted in FIGS. 1 to 6, the projecting portions 42 of the slider members 16 are disposed to project to the outer circumferential side around the pump axial center RC1 and the cam groove 60 of the pump body 14 is disposed in the inner circumferential surface 56 of the pump body 14; however, the projecting portions 42 and the cam groove 60 only need to cause the slider members 16 to reciprocate in the pump axial center RC1 direction in association with the rotation of the pump rotor 12 and are not limited to the arrangement depicted in FIGS. 1 to 6.

In the first example, since the discharge ports 76 are disposed at two places as depicted in FIG. 1, a discharge pressure may be changed for each of the discharge ports 76 such that an original pressure is supplied to a separate hydraulic control circuit from each of the two discharge ports 76. By achieving the discharge pressures suitable for respective hydraulic control circuits, pump work W (=discharge pressure×discharge flow quantity) can be reduced as compared to the case that, for example, the two discharge ports 76 are integrated into one system before branching to the respective hydraulic control circuits.

In the first example, although the slider members 16 reciprocate twice per rotation of the pump rotor 12 and the stroke amounts STRK of the slider members 16 are equal between the first and second reciprocations, the stroke amounts STRK may be different from each other.

Although the pump body 162 has the two cam grooves 60 and 160 formed in parallel in the second example, for example, the pump body 162 may be formed with three or more cam grooves and the cam groove switch mechanism 164 may switch the cam groove having the projecting portions 42 of the slider members 16 fitted therein to one of a plurality of the cam grooves.

Although the vehicle oil pumps 10 and 150 are rotationally driven by the engine in the first and second examples, a drive power source is not particularly limited and, for example, the vehicle oil pump may be rotationally driven by an electric motor.

Although a hydraulic supply source of a vehicle transmission is described as a use of the vehicle oil pumps 10 and 150 in the first and second examples, this is not a limitation of the use of the vehicle oil pumps 10 and 150.

Although the cam groove 60 is formed in the pump body 14 and the slider members 16 are disposed relatively immovably in the circumferential direction around the pump axial center RC1 and slidably in the direction parallel to the pump axial center RC1 with respect to the pump rotor 12 in the first and second examples, the cam groove 60 may be formed in the pump rotor 12 and the slider members 16 may be disposed relatively immovably in the circumferential direction around the pump axial center RC1 and slidably in the direction parallel to the pump axial center RC1 relative to the pump body 14 in a possible configuration.

Although the slider members 16 are arranged to be separated one-by-one by the partition portions 30 of the pump rotor 12 as depicted in FIG. 1 in the first and second examples, the slider members 16 may not be separated one-by-one by the partition portions 30 and, for example, the slider members 16 may be separated every two or three slider members 16 by the partition portions 30.

Although the vehicle oil pumps 10 and 150 include the 28 slider members 16 as depicted in FIG. 1 in the first and second examples, the number of the slider members 16 may be smaller or larger than 28 and, in an extreme example, the number of the slider members 16 may be one.

NOMENCLATURE OF ELEMENTS

10, 150: vehicle oil pump 12: pump rotor (first member) 14, 162: pump body (second member) 16: slider members 42: projecting portion 56: inner circumferential surface (circumferential surface) 60: cam groove 80: oil chamber 160: second cam groove 164: cam groove switching mechanism RC1: pump axial center (one axial center)

The invention claimed is:

1. A vehicle oil pump, comprising:

a first member and a second member relatively rotatable around one axial center such that one of the first member and the second member is inserted in an inner circumferential side of the other, the second member comprising a plurality of cam grooves formed in a circumferential surface of the second member facing the first member, a slider member interposed between the first member and the second member in a direction orthogonal to the one axial center, the slider member being relatively immovable in circumferential direction around the one axial center with respect to the first member and slidable in direction parallel to the one axial center, the plurality of cam grooves comprising at least a first cam groove and a second cam groove, a projecting portion disposed on the slider member being fitted in the first cam groove, and the first cam groove causing the slider member to reciprocate in the one axial center direction in association with rotation of the slider member relative to the second member around the one axial center, the second cam groove being formed in the second member so as to be connected to the first cam groove, and a cam groove switching mechanism configured to switch a route through which the projecting portion of the slider member passes between the plurality of cam grooves.

2. The vehicle oil pump of claim 1, wherein the first cam groove causes the slider member to reciprocate in the one axial center direction twice or more each time the first member and the second member rotate once relative to each other.

3. The vehicle oil pump of claim 1, wherein the second member is a non-rotating member while the first member is a rotating member rotatable around the one axial center.

4. The vehicle oil pump of claim 1, wherein a plurality of the slider members are annularly disposed around the one axial center between the first member and the second member, wherein capacities of a plurality of oil chambers surrounded and formed by the first member, the second member, and the slider members are changed by reciprocating movement of the slider members corresponding to a relative rotation angle between the first member and the second member.

* * * * *